US010603539B2

(12) United States Patent
Moon et al.

(10) Patent No.: US 10,603,539 B2
(45) Date of Patent: Mar. 31, 2020

(54) OMNIDIRECTIONAL TREADMILL APPARATUS

(71) Applicants: GWANGJU INSTITUTE OF SCIENCE AND TECHNOLOGY, Gwangju (KR); Tae-ye Moon, Gyeongsangnam-do (KR); ELECTRONICS AND TELECOMMUNICATIONS RESEARCH INSTITUTE, Daejeon (KR)

(72) Inventors: Tae-ye Moon, Gyeongsangnam-do (KR); Jung-won Yoon, Gyeongsangnam-do (KR); Sang-hun Pyo, Gyeongsangnam-do (KR); Ho-soo Lee, Gyeongsangnam-do (KR); Sang-joon Park, Daejeon (KR); So-yeon Lee, Daejeon (KR)

(73) Assignees: GWANGJU INSTITUTE OF SCIENCE AND TECHNOLOGY, Gwangju (KR); Tae-Ye Moon, Gyeongsangnam-Do (KR); ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 144 days.

(21) Appl. No.: 15/578,081

(22) PCT Filed: May 4, 2016

(86) PCT No.: PCT/KR2016/004695
§ 371 (c)(1),
(2) Date: Nov. 29, 2017

(87) PCT Pub. No.: WO2016/195255
PCT Pub. Date: Dec. 8, 2016

(65) Prior Publication Data

US 2018/0147442 A1 May 31, 2018

(30) Foreign Application Priority Data

May 29, 2015 (KR) ..... 10-2015-0076318

(51) Int. Cl.
*A63B 22/02* (2006.01)
*A63B 23/04* (2006.01)

(52) U.S. Cl.
CPC ..... *A63B 22/0285* (2013.01); *A63B 22/025* (2015.10); *A63B 22/0235* (2013.01);
(Continued)

(58) Field of Classification Search
CPC . A63B 22/0046; A63B 22/02; A63B 22/0707; A63B 22/0214; A63B 22/0221;
(Continued)

(56) References Cited

U.S. PATENT DOCUMENTS 5,562,572 A * 10/1996 Carmein ..... A61H 3/00 482/4
6,123,647 A * 9/2000 Mitchell ..... A63B 22/02 198/456

(Continued)

FOREIGN PATENT DOCUMENTS

JP 2002-293425 A 10/2002
KR 10-0867171 B1 11/2008

OTHER PUBLICATIONS

Ho-Su Lee et al., "Kinematic Design of a Fast Omni Directional Treadmill Based on an Omni-Pulley Mechanism", Electronics and Telecommunications Research Institute, May 7, 2015, 4 Pages.

*Primary Examiner* — Gary D Urbiel Goldner
(74) *Attorney, Agent, or Firm* — Brooks Kushman P.C.

(57) ABSTRACT

An omnidirectional treadmill apparatus. The omnidirectional treadmill apparatus includes: a plurality of segments which are continuously arranged along the direction of a first axis, each of which having a belt part; a first rotation unit for rotating the plurality of segments along the direction of the first axis; and a second rotation unit for rotating the belt part of each segment in the direction of a second axis which is perpendicular to the first axis, wherein the belt part has a toothed surface which is tooth-engaged with the second rotation unit.

9 Claims, 3 Drawing Sheets

(52) U.S. Cl.
CPC ... *A63B 23/0405* (2013.01); *A63B 2022/0271* (2013.01); *A63B 2022/0278* (2013.01); *A63B 2209/00* (2013.01)

(58) Field of Classification Search
CPC ..... A63B 22/0228; A63B 22/0235; A63B 22/0242; A63B 22/025; A63B 22/0257; A63B 22/0285; A63B 2022/0271; A63B 2022/0278; A63B 23/035; A63B 23/03516; A63B 23/03525; A63B 23/04; A63B 23/0405; A63B 23/0482; A63B 23/0494; A63B 26/00; A63B 26/003; A63B 69/0028; A63B 69/0035; A63B 2208/0204; A63B 2209/00
See application file for complete search history.

(56) References Cited

U.S. PATENT DOCUMENTS

| | | | | |
|---|---|---|---|---|
| 6,152,854 | A * | 11/2000 | Carmein | A63B 22/025 482/4 |
| 6,669,012 | B1 | 12/2003 | Yoshida et al. | |
| 7,399,258 | B1 * | 7/2008 | Sugar | A63B 22/0235 482/51 |
| 7,780,573 | B1 | 8/2010 | Carmein | |
| 2004/0048722 | A1 * | 3/2004 | Epstein | A63B 22/02 482/54 |
| 2005/0148432 | A1 * | 7/2005 | Carmein | A63B 22/0235 482/8 |
| 2005/0266963 | A1 * | 12/2005 | Holmes | A63B 22/02 482/54 |
| 2007/0270285 | A1 | 11/2007 | Gill et al. | |
| 2009/0058855 | A1 * | 3/2009 | Mishra | B65G 13/10 345/427 |
| 2010/0022358 | A1 * | 1/2010 | Schwaiger | A63B 22/0242 482/54 |
| 2010/0147430 | A1 * | 6/2010 | Shultz | B60C 7/18 152/450 |
| 2010/0170769 | A1 | 7/2010 | Jung | |
| 2012/0302408 | A1 | 11/2012 | Burger | |
| 2014/0179490 | A1 * | 6/2014 | Schmitz | A63B 21/15 482/4 |
| 2016/0199695 | A1 * | 7/2016 | Armstrong | A63B 22/0235 482/8 |

* cited by examiner

【figure 1】
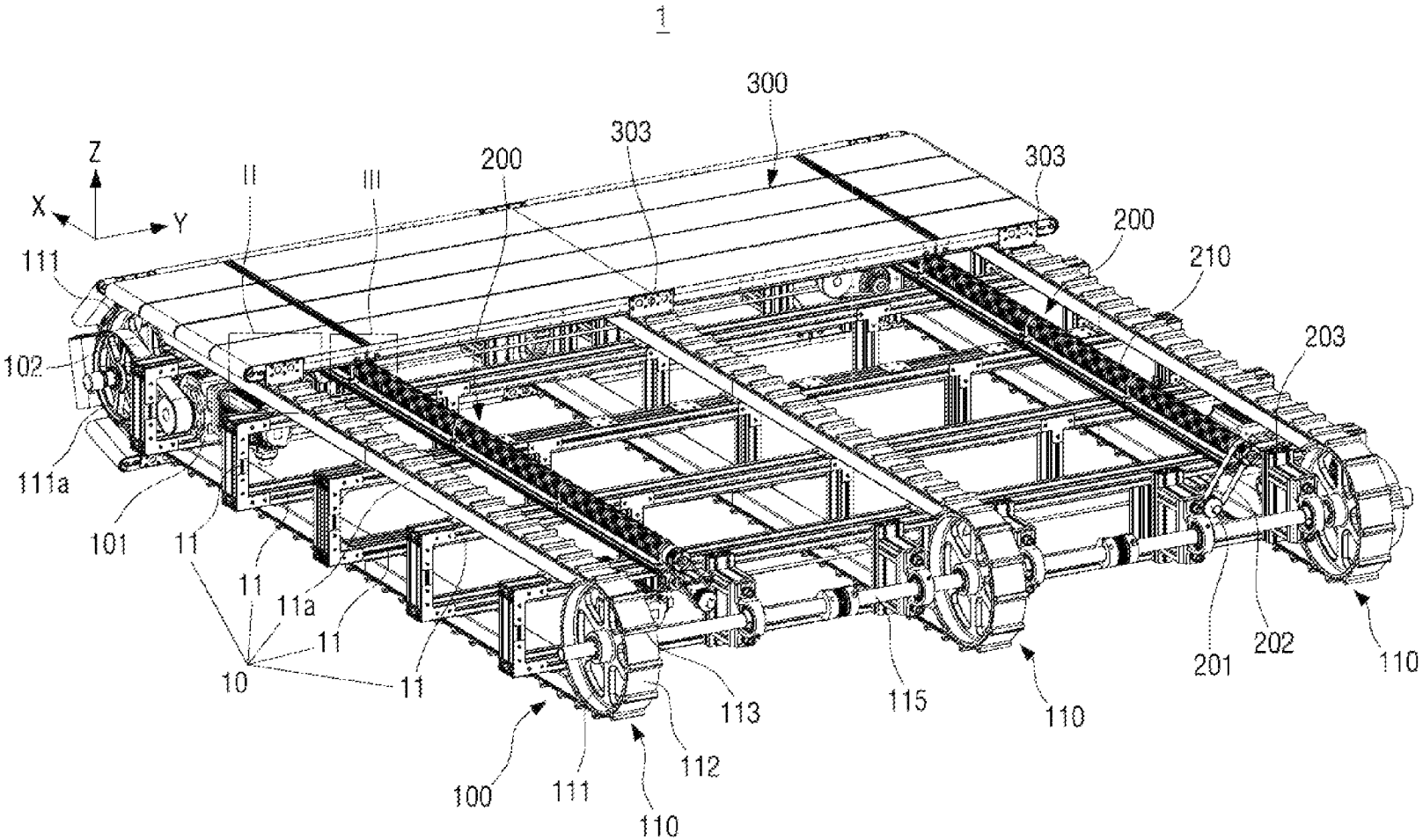

【Figure 2】
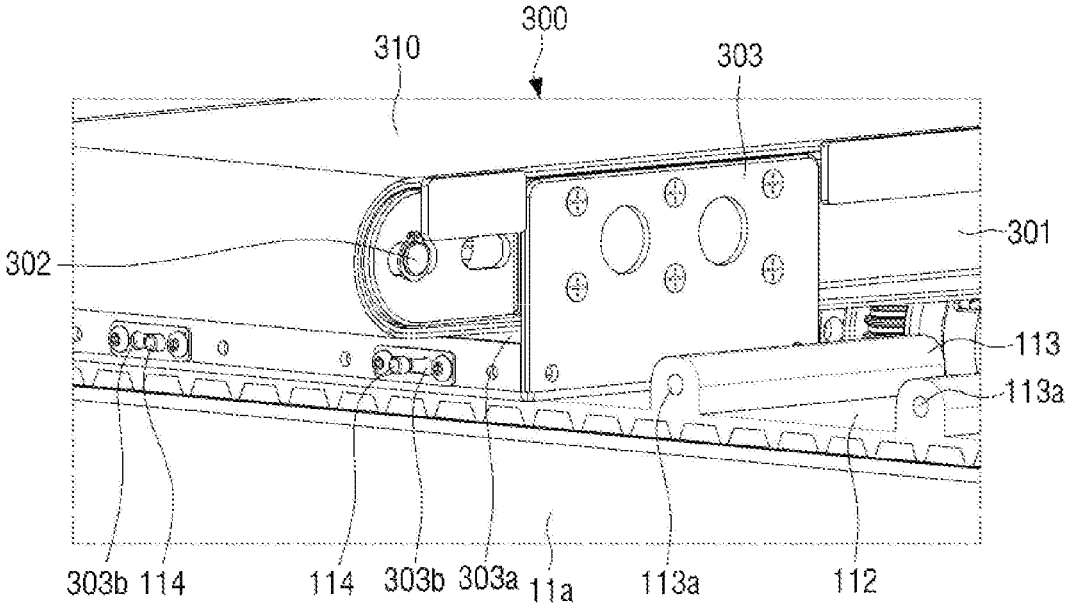
【Figure 3】
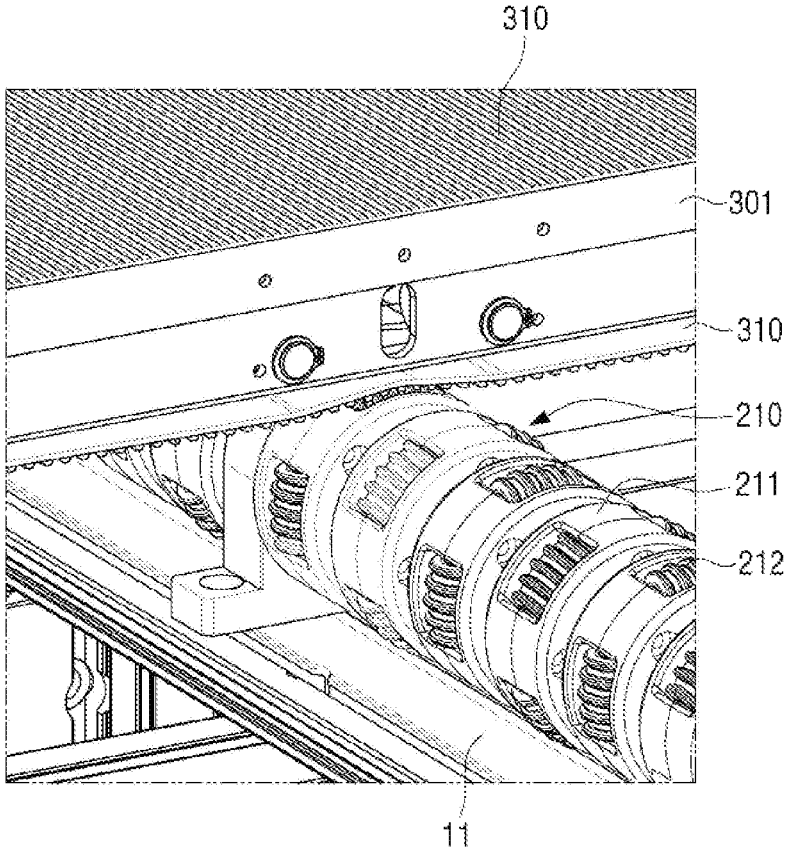

【Figure 4】
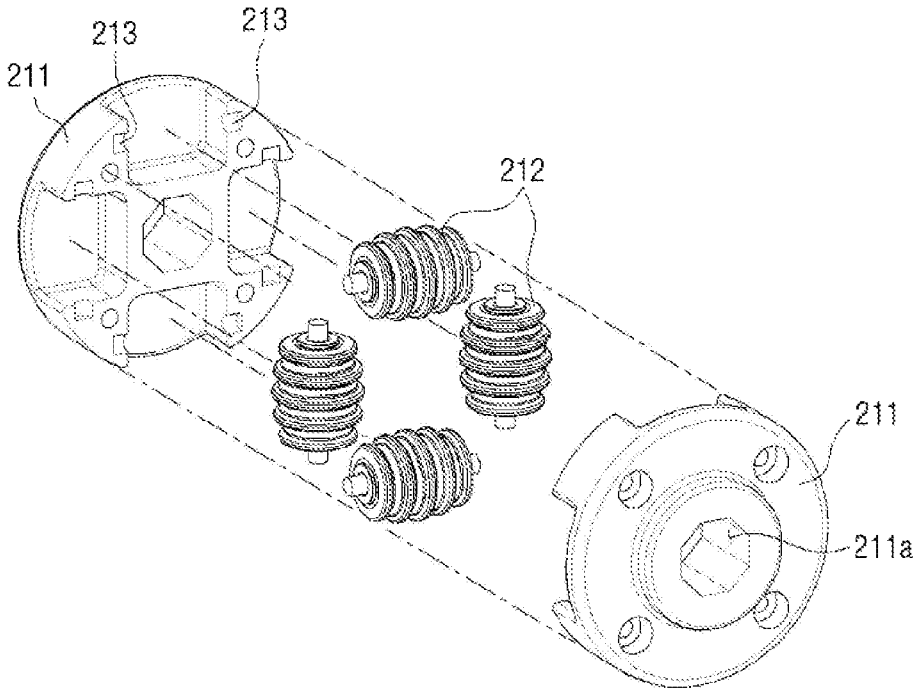
【Figure 5】
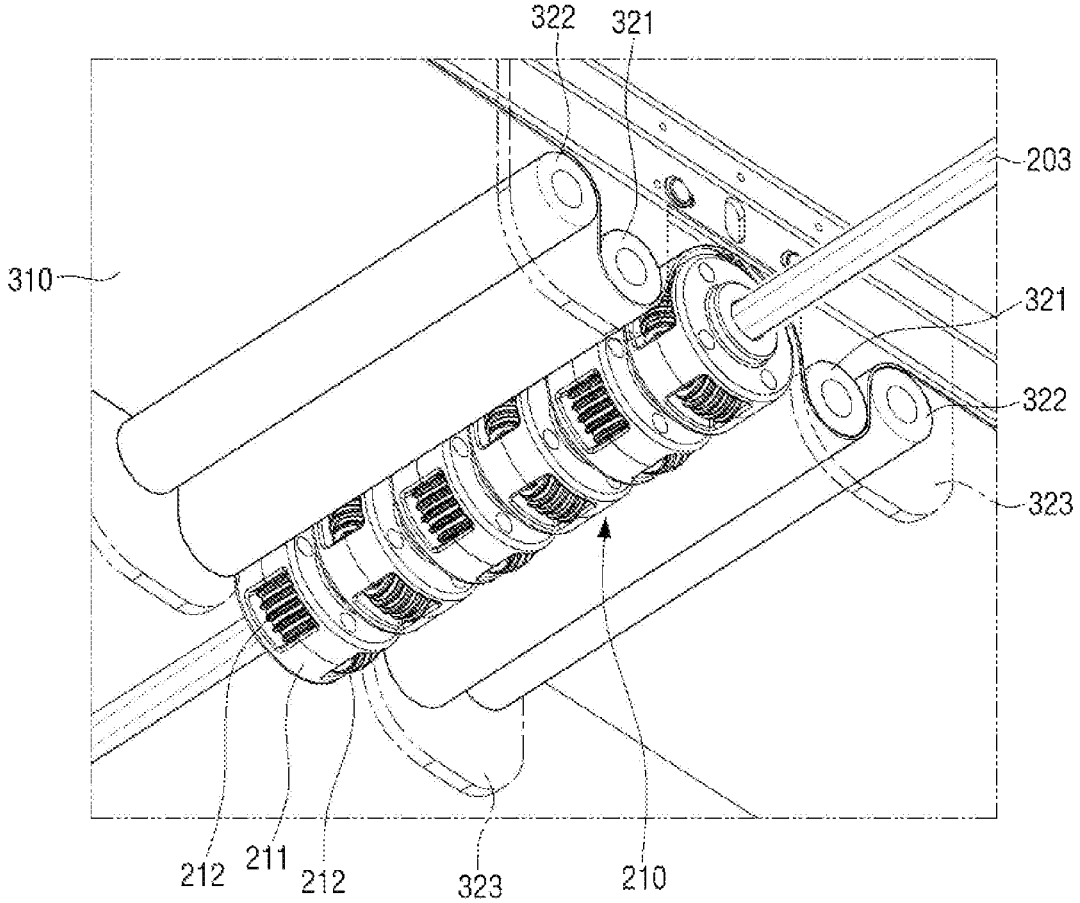

OMNIDIRECTIONAL TREADMILL APPARATUS

CROSS-REFERENCE TO RELATED APPLICATION

This application is the U.S. national phase of PCT Application No. PCY/KR2016/004695 filed on May 4, 2016, which claims priority to KR Patent Application No. 10-2015-0076318 filed on May 29, 2015, the disclosures of which are incorporated in their entirety by reference herein.

TECHNICAL FIELD

The present invention relates to a treadmill apparatus, and more particularly, to a treadmill apparatus on which a user can walk in all directions.

BACKGROUND ART

In general, a platform providing an omnidirectional walking interface can be roughly divided into a passive type platform in which a user directly pushes the platform and an active type platform to which a driving source is attached.

Firstly, there is a platform developed by Virtual Sphere Limited as the passive type platform. The platform developed by Virtual Sphere Limited has a hollow large spherical steel structure on a roller with two degrees of freedom, and the spherical steel structure is passively rotated when the user performs a walking operation within the spherical steel structure. Although this passive type platform enables an omnidirectional walking interface to be obtained, a driving source cannot be applied to the platform, and the platform interferes with immersion feeling due to the inertia of the structure when the user is advancing at a high speed, thereby providing a heterogeneous walking floor sense as the floor representation is not flat.

Another passive type platform is an omni pad. However, simply rolling on a sliding pad cannot provide a sense of force like actual walking in a state that the body of the user is constrained.

In the meanwhile, as the active type platform, there is the omnidirectional floor developed and successfully commercialized by MSE weibull. Such an active type platform is configured to place 16 discrete triangular-shaped rollers in a circular form, thereby providing entertainment factors of virtual reality to increase fun. However, when the user is simply away from a central point, the rollers attached to respective segments have only the function of causing the user to move toward the center of the platform by means of rotation of rollers using a motor and cannot support transverse or advancing operations, so that it cannot be considered an interface supporting the omnidirectional walking.

An active type platform that can substantially support the omnidirectional walking is an active type platform developed by the European consortium and an active type platform developed by the US Army Research Laboratory.

In the case of the active type platform developed by the European consortium there is a problem that the power of the motor responsible for Y-axis rotation needs to be significantly increased by attaching a motor to each of the segments for causing the interface to move in the X axis by means of rotation of the segments. In addition, both reactivities of two axes are also decreased due to limitations on the weight of the segment itself for driving the X axis, a complexity thereof, and a small-sized power motor.

In the case of the active type platform developed by the US Army Research Laboratory, it acts as the walking interface in the Y-axis direction through rotation of the segment itself. In this case, rotation of the segments occurs in the X-axis direction in a point friction wheel driving manner that utilizes a plurality of omni wheels on the platform itself instead of a method of attaching a motor to each segment, thereby securing a simpler and higher acceleration and deceleration performance than the an active type platform developed by the European consortium. However, power cannot be reliably transmitted even when a powerful driving source is employed and a very large number of omni wheels need to be driven in order to maintain a consistent friction due to the inefficiency of power transmission of the omni wheels, so that the active type platform developed by the US Army Research Laboratory has a clear limitation on a high performance of acceleration and deceleration interface with respect to the X-axis direction (i.e., a speed equal to or less than 1 $m/s^2$).

DISCLOSURE

Technical Problem

To solve the problems mentioned above, an object of the prevent invention is to provide an omnidirectional treadmill apparatus that minimizes the loss of power transmitted from a driving source to obtain a high acceleration and deceleration performance and reliable power transmission.

Technical Solution

To achieve the object, one aspect of the present invention provides an omnidirectional treadmill apparatus, which includes: a plurality of segments which are continuously arranged along the direction of a first axis, each of which having a belt part; a first rotation unit for rotating the plurality of segments along the direction of the first axis; and a second rotation unit for rotating the belt part of each segment in the direction of a second axis which is orthogonal to the first axis, wherein the belt part has a toothed surface which is tooth-coupled with the second rotation unit.

In this case, the second rotation unit may include: at least one rotation shaft disposed along the direction of the first axis; and a plurality of omni pulleys fixedly coupled to the rotation shaft and each of the omni pulleys having a case, wherein each of the omni pulleys may include a plurality of interference rollers interlocked with the toothed surface of the belt part.

Moreover, the plurality of interference rollers may be disposed at a predetermined interval along an outer periphery of the case and rotate about an imaginary axis orthogonal to the rotation shaft.

In addition, the plurality of interference rollers may be disposed in groups by at least one pair at a predetermined interval along an outer periphery of the case and rotate about an imaginary axis orthogonal to the rotation shaft.

In addition, the omni pulleys may be disposed such that the plurality of interference rollers provided in the omni pulley are offset from the plurality of interference rollers provided in the adjacent omni pulley.

In addition, the segment may further include a plurality of guide rollers configured to guide the belt part to surround a portion of the second rotation unit.

In this case, the plurality of guide rollers may be disposed in parallel with the first axis, some of the guide rollers may be disposed at one side of the second rotation unit and the other guide rollers may be disposed at the opposite side of the second rotation unit.

In addition, the plurality of the segments may be seated on the first rotation unit, the first rotation unit may include at least one rail unit having a plurality of connection protrusions protruding toward the plurality of the segments, and the plurality of segments may include connection ribs that are connected to the plurality of the connection protrusions to receive power for rotational driving along the first axis direction.

In this case, the connection protrusions and the connection ribs may be fixed to each other by means of a pin or a screw.

In addition, the rail unit may be made of a polyurethane material.

Advantageous Effects

According to the present invention, a belt part having a toothed surface is applied to a segment, and power is transmitted by an omni pulley formed to be tooth-coupled with the surface of the belt part, so that the loss of power can be minimized, and a high acceleration and deceleration performance and reliable power transmission can be achieved.

DESCRIPTION OF DRAWINGS

FIG. 1 is a perspective view illustrating an omnidirectional treadmill apparatus according to an embodiment of the present invention.

FIG. 2 is a partial perspective view illustrating a portion at which a first rotation unit and a segment shown in FIG. 1 meet.

FIG. 3 is a partial perspective view illustrating a portion at which a second rotation unit and a segment shown in FIG. 1 meet.

FIG. 4 is an exploded perspective view illustrating an omni pulley of the second rotation unit shown in FIG. 1.

FIG. 5 is a partial perspective view illustrating a modified embodiment of the segment shown in FIG. 1.

MODES OF THE INVENTION

Hereinafter, an embodiment of an omnidirectional treadmill apparatus 1 according to the present invention will be described with reference to the accompanying drawings. In the following description, when it is determined that detailed description of well-known functions or components may obscure the subject matter of the present invention, the detailed description thereof will be omitted. Also, for ease of understanding of the invention, the accompanying drawings are not drawn to scale, but the dimensions of some of the components may be exaggerated.

Referring to FIG. 1, an omnidirectional treadmill apparatus 1 (hereinafter referred to as a "treadmill apparatus") according to an embodiment of the present invention includes a base 10, a first rotation unit 100, a second rotation unit 200, and a plurality of segments 300.

The base 10 is provided with a plurality of the first rotation units 100 and a plurality of the second rotation units 200, and includes a plurality of support members 11 and 11*a* disposed along a longitudinal axis (hereinafter referred to as a first axis X), a width direction axis (hereinafter referred to a second axis Y), and a height direction axis (hereinafter referred to as a third axis Z) of the treadmill apparatus 1.

The first rotation unit 100 provides a walking interface in the direction of the first axis X, and includes a first driving source 101, a first power transmitting unit 102, and a rail unit 110.

The first driving source 101 provides power for driving the first rotation unit 100, and may be a servo motor capable of forward and reverse rotating.

The first power transmitting unit 102 is connected to the first driving source 101, and transmits the power generated from the first driving source 101 to the rail unit 110. The first power transmitting unit 102 may be a timing belt connecting the rotation axis of the first driving source 101 and the rail unit 110.

Referring to FIGS. 1 and 2, the rail unit 110 is disposed on the base 10 in parallel with the first axis X direction of the treadmill apparatus 1 and includes a plurality of segments 300 on one surface in which a connection protrusion 113 is formed. The rail unit 110 includes a rotation wheel 111, a seating belt 112, and a connection protrusion 113.

The rotation wheel 111 is disposed at each of front and rear ends of the treadmill apparatus 1, and guides the seating belt 112 so that the seating belt 112 can be rotationally driven along the first axis X direction. In addition, the rotation wheel 111 is connected to the first power transmitting unit 102 and forms an auxiliary wheel 111*a* at one side to receive the power from the first power transmitting unit 102.

The seating belt 112 is supported by the rotation wheel 111 disposed at each of the front and rear ends of the treadmill apparatus 1 and the support member 11*a* of the base 10 disposed between the rotation wheels 111, and is rotationally driven along the first axis X direction. A plurality of segments 300 are seated on and fixed to the seating belt 112. In addition, the seating belt 112 may be made of a polyurethane material, and the present invention can thus reduce noise during driving in the first axis X direction, and the weight of the entire treadmill apparatus 1 can be reduced.

A plurality of connection protrusions 113 protrude from the outer surface of the seating belt 112 on which the segments 300 are seated, and include first connection ports 113*a* for connection with the plurality of segments 300. This first connection port 113*a* is coupled to the segment 300 by means of a pin or screw 114, and the driving force of the seating belt 112 is thus transmitted directly to the segment 300.

In this embodiment, three such rail units 110 are shown to be disposed in parallel with the first axis X. However, the present invention is not limited thereto, and only two of them may be provided at both ends, or only the central one of them may be provided. It is also possible to provide four or more rail units, but in this case, it is desirable to dispose the rail units so that the right and left sides are symmetrical. In addition, in the case of the first driving source 101, it may be disposed in each of the rail units 110. However, in order to reduce the manufacturing cost, the first driving source 101 may be installed in only one of the rail units 110, and the other rail units 110 may be rotationally driven by one shaft 115 connecting the rotation wheels 111 of the rail units.

Referring to FIGS. 1 and 3, the second rotation unit 200 rotationally drives a belt part 310 of the segment 300 along the second axis Y, and includes a second driving source 201, a second power transmitting unit 202, a rotation shaft 203, and a plurality of omni pulleys 210.

The second driving source 201 provides power for driving the second rotation unit 200, and may be a servo motor capable of forward and reverse rotating.

The second power transmitting unit 202 is connected to the second driving source 201 and transmits the power generated from the second driving source 201 to the rotation shaft 203. This second power transmitting unit 202 may be a timing belt connecting the rotation axis of the second driving source 201 and the rotation shaft 203.

The rotation shaft 203 is disposed in parallel with the first axis X. Furthermore, when a plurality of rail units 110 are provided, the rotation shaft 203 is preferably disposed between the plurality of rail units 110. The rotation shaft 203 rotates upon receipt of the power from the second driving source 201.

Referring to FIGS. 3 and 4, a plurality of omni pulleys 210 are continuously and fixedly coupled to the rotation shaft 203 along the first axis X direction, and rotate along the second axis Y direction as the rotation shaft 203 rotates. The omni pulley 210 includes a case 211 and a plurality of interference rollers 212.

The case 211 forms an appearance of the omni pulley 210 and has a coupling port 211*a* to be coupled with the rotation shaft 203. It is preferable that the coupling port 211*a* has the same shape as a cross section of the rotation shaft 203. Further, in order to prevent the omni pulley 210 from rotating with respect to the rotation shaft 203, the cross section of the rotation shaft 203 preferably has a polygonal shape. The case 211 is fixed using a pin or a screw so as to prevent the interference roller 212 from coming out of the case after the interference roller 212 is coupled to the inside of the case 211.

The plurality of interference rollers 212 are provided on an outer circumferential surface of the case 211 so as to protrude from the outer circumferential surface of the case 211. Accordingly, the plurality of interference rollers 212 are tooth-coupled with a surface of the belt part 310 of the segment 300, which will be described later.

In addition, the plurality of interference rollers 212 are rotatably provided about an imaginary axis orthogonal to the first axis X. Specifically, in the present embodiment, four interference rollers 212 are provided, and these interference rollers 212 are rotatably coupled to a mounting groove 213 of the case 211. Accordingly, the plurality of interference rollers 212 rotate on the surface of the belt part 310 when the segment 300 is rotationally driven along the first axis X direction, and do not interfere with the driving of the belt part 310.

The plurality of interference rollers 212 may be disposed in groups by a pair of the interference rollers 212 as shown in the drawings, or, although not shown, they may be disposed apart from each other. However, it is desirable to minimize an interval between the plurality of interference rollers 212 in order to reduce a portion slipped during tooth coupling with the surface of the belt part 310.

In addition, when the plurality of interference rollers 212 are arranged in pairs, the interference roller 212 is preferably configured such that the portion protruding from the outer circumferential surface of the case 211 has a predetermined curvature like the outer circumferential surface of the case 211. That is, it is preferable that the pair of interference rollers 212 are provided so as to have a smaller radius toward the interference rollers 212 disposed on both sides from the central interference roller 212. Accordingly, the belt part 310 can be naturally coupled at a boundary portion of the pair of interference rollers 212 and the case 211, and therefore, the power loss can be minimized.

In order that an outer edge has a shape having a predetermined curvature like the outer circumferential surface of the case 211, In addition, when the plurality of omni pulleys 210 are continuously coupled to the rotation shaft 203, a plurality of interference rollers 212 are preferably disposed so as to be deviated from the interference rollers 212 of the adjacent omni pulleys 210. This allows the adjacent omni pulley 210 to prevent a slipping with the belt part 310 that may occur due to the surface on which the interference roller 212 is not provided on the outer circumference of the case 211.

Referring to FIGS. 1 and 2, a plurality of segments 300 are seated on the first rotation unit 100 and the second rotation unit 200, and provide a floor on which a user can walk. The segment 300 includes a frame 301, a rotation guide 302, a connection rib 303, and a belt part 310.

The frame 301 has a rectangular column shape extending along the second axis Y and has the rotation guide 302 at both ends thereof. Accordingly, the belt part 310, which is coupled by wrapping around an outer surface, can be naturally rotated along the second axis Y direction.

The connection rib 303 is formed to protrude toward the rail unit 110 at a portion where the segment 300 meets the rail unit 110. Therefore, in the present embodiment, since three rail units 110 are provided, it is preferable that three connection ribs 303 are also provided. In addition, it is preferable that the connection rib 303 secures a section 303*a* through which the belt part 310 passes for rotationally driving the belt part 310.

The connection rib 303 is connected to the connection protrusion 113 of the rail unit 110 to receive power from the first rotation unit 100. Specifically, a second connection port 303*b* of the connection rib 303 is arranged on the same axis as the first connection port 113*a* of the connection protrusion 113, and the pin or the screw 114 penetrates the first connection port 113*a* and the second connection port 303*b* to connect the first and second connection ports.

The belt part 310 is disposed on an outer surface of the frame 301 so as to be rotatable in the second axis Y direction along the outer surface of the frame 301. The belt part 310 is a timing belt, and thus is tooth-coupled with the omni pulley 210 of the second rotation unit 200. In this case, approximately five to six omni pulleys 210 are tooth-coupled with one segment 300.

By virtue of the tooth-coupling between the belt part 310 and the omni pulley 210, the segment is not subjected to the interference of the second rotation unit 200 when the segment 300 is rotationally driven along the first axis X direction, and can receive the power from the second rotation unit 200 when it rotates along the Y-axis direction.

Referring to FIG. 5, the segment 300 of the treadmill apparatus 1 according to an embodiment of the present invention may further include a guide roller 321 that guides the belt part 310 so as to increase the area of the tooth coupling by contact between the belt part 310 and the omni pulley 210.

The guide roller 321 is disposed in parallel with the first axis X and is arranged one on each side of the omni pulley 210. The guide roller 321 disposed in this manner presses the belt part 310 downward so that the belt part 310 surrounds the omni pulley 210. That is, since the belt part 310 is tooth-coupled with the omni pulley 210 in a larger area, it is possible to further reduce the loss that may occur in power transmission.

In addition, in order to prevent the entire belt part 310 from being lifted by the guide roller 321, an auxiliary guide roller 322 may be additionally provided. This auxiliary guide roller 322 is disposed to be closer to the segment 300 than the guide roller 321, presses the belt part 310 toward the segment 300, and is in contact with the surface of the belt part opposite to the surface of the belt part in contact with the guide roller 321.

In addition, it is preferable that the guide roller 321 and the auxiliary guide roller 322 are rotatable by fixing central axes thereof to a bracket 323 attached to the frame 301 of the segment 300. Accordingly, the belt part 310 is rotationally driven in the second axis Y direction while sequentially passing through the auxiliary guide roller 322, the guide roller 321 and the omni pulley 210 in this order.

Hereinafter, operations of the treadmill apparatus 1 according to the embodiment of the present invention will be described.

Firstly, if the user wants to move forward and backward along the first axis X direction on the treadmill apparatus 1, only the first rotation unit 100 is operated to rotationally drive the segment 300 along the first axis X direction. Accordingly, the user can move only along the first axis X direction. In this case, since the interference roller 212 of the omni pulley 210 rotates along the surface of the belt part 310 of the segment 300 as the segment 300 is rotationally driven along the first axis X direction, driving in the direction of the first axis X is not influenced at all.

Next, if the user wants to move left and right along the second axis Y direction on the treadmill apparatus 1, only the second rotation unit 200 is operated to rotationally drive the belt part 310 of the segment 300 along the second axis (Y) direction. Accordingly, the user can move only along the second axis Y direction.

In addition, if the user wants to move on the treadmill apparatus 1 in all directions, both the first rotation unit 100 and the second rotation unit 200 are operated to rotationally drive the segment 300 along the first axis X direction and rotationally drive the belt part 310 of the segment 300 along the second axis Y direction at the same time. In this case, the combination of movements of the segment 300 and the belt part 310 in the directions of the first axis X and the second axis Y allows the user to move in all directions by appropriately controlling the driving speeds of the first rotation unit 100 and the second rotation unit 200.

In addition, since the interference roller 212 of the omni pulley 210 rotates when the segment 300 is driven in the first axis X direction and transmits the power to the belt part 310 when the segment is driven in the second axis Y direction, driving in the directions of the first axis X and the second axis Y has no mutual influence. In addition, according to this structure, a walking interface in all directions becomes possible.

As described above, the treadmill apparatus 1 according to the present invention can rotationally drive the plurality of segments 300 in the second axis Y direction without slipping and does not influence the rotational driving in the first axis X direction, so that the walking interface becomes possible in all directions. In addition, since the treadmill apparatus 1 of the present invention can be driven even if only one driving source is provided in each of the first axis X and the second axis Y directions, the manufacturing cost can be reduced.

As described above, although the present invention has been described with reference to the limited embodiments and drawings, the present invention is not limited thereto, and various changes and modifications may be made without departing from the spirit and scope of the present invention as defined by the appended claims and their equivalents.

The invention claimed is:

1. An omnidirectional treadmill apparatus comprising:

a plurality of segments which are continuously arranged along a direction of a first axis, and each of the plurality of segments having a belt part;

a first rotation unit for rotating the plurality of segments along the direction of the first axis; and a second rotation unit for rotating the belt part of each of the plurality of segments in a direction of a second axis which is orthogonal to the first axis, wherein the belt part has a toothed surface which is tooth-coupled with the second rotation unit, wherein the second rotation unit comprises:

at least one rotation shaft disposed along the direction of the first axis; and a plurality of omni pulleys fixedly coupled to the at least one rotation shaft, each of the plurality of the omni pulleys having a case, wherein each of the plurality of the omni pulleys comprises a plurality of interference rollers tooth-coupled with the toothed surface of the belt part.

2. The apparatus of claim 1, wherein the plurality of interference rollers are disposed at a predetermined interval along an outer periphery of the case and rotate about an imaginary axis orthogonal to the at least one rotation shaft.

3. The apparatus of claim 1, wherein the plurality of interference rollers are disposed in groups by at least one pair at a predetermined interval along an outer periphery of the case and rotate about an imaginary axis orthogonal to the at least one rotation shaft.

4. The apparatus of claim 1, wherein the plurality of omni pulleys are disposed such that the plurality of interference rollers provided in each respective omni pulley are deviated from the plurality of interference rollers provided in a respective adjacent omni pulley.

5. The apparatus of claim 1, wherein each of the plurality of segments further comprises a plurality of guide rollers configured to guide the belt part to surround a portion of the second rotation unit.

6. The apparatus of claim 5, wherein the plurality of guide rollers are disposed in parallel with the first axis, some of the plurality of the guide rollers are disposed at a first side of the second rotation unit and the other of the plurality of guide rollers are disposed at a second side of the second rotation unit, opposite the first side.

7. An omnidirectional treadmill apparatus comprising:

a plurality of segments which are continuously arranged along a direction of a first axis, and each of the plurality of segments having a belt part;

a first rotation unit for rotating the plurality of segments along the direction of the first axis; and a second rotation unit for rotating the belt part of each of the plurality of segments in a direction of a second axis which is orthogonal to the first axis, wherein the belt part has a toothed surface which is tooth-coupled with the second rotation unit, wherein the plurality of segments are seated on the first rotation unit, the first rotation unit comprises at least one rail unit having a plurality of connection protrusions protruding toward the plurality of segments, and the plurality of segments respectively comprises connection ribs that are respectively connected to the plurality of connection protrusions to receive power for rotational driving along the direction of the first axis.

8. The apparatus of claim 7, wherein the plurality of connection protrusions and the connection ribs are respectively fixed to each other by means of a pin or a screw.

9. The apparatus of claim 7, wherein the at least one rail unit is made of a polyurethane material.

* * * * *